US006282384B1

(12) United States Patent
Saito et al.

(10) Patent No.: US 6,282,384 B1
(45) Date of Patent: Aug. 28, 2001

(54) DEVELOPING DEVICE, PROCESS CARTRIDGE AND ELECTROPHOTOGRAPHIC IMAGE FORMING APPARATUS

(75) Inventors: Seiji Saito; Hiroaki Sakai, both of Mishima; Masaru Shimura, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/577,874

(22) Filed: May 25, 2000

(30) Foreign Application Priority Data

May 27, 1999 (JP) ..... 11-148917

(51) Int. Cl.[7] ..... G03G 15/08
(52) U.S. Cl. ..... 399/27; 399/61
(58) Field of Search ..... 118/688, 693; 399/27, 28, 29, 30, 58, 61, 62

(56) References Cited

U.S. PATENT DOCUMENTS 5,987,269 * 11/1999 Allen et al. ..... 399/27
6,144,815 * 11/2000 Chadani et al. ..... 399/27
6,208,816 * 3/2001 Koizumi et al. ..... 399/27

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A developing device mounted on a main body of an electrophotographic image forming apparatus and adapted to develop an electrostatic latent image formed on an electrophotographic photosensitive member, includes a developer container which contains a developer therein and has a developer bearing member for feeding the developer to the electrophotographic photosensitive member in order to develop the electrostatic latent image formed on the electrophotographic photosensitive member, and N ($N \geqq 2$) antenna electrodes for detecting the residual amount of developer within the developer container by detecting a variation of capacitance due to a developing bias voltage applied to the developer bearing member; wherein a projected area (S) and a distance (R) of the n-th antenna from the developer bearing member satisfy $Sn-1 \leqq Sn$, and $Rn-1 \leqq Rn$ ($2 \leqq n \leqq N$).

27 Claims, 10 Drawing Sheets

DEVELOPING DEVICE, PROCESS CARTRIDGE AND ELECTROPHOTOGRAPHIC IMAGE FORMING APPARATUS

BACKGROUND OF THE INVENTION

1. Field of the Invention

The present invention relates to an electrophotographic image forming apparatus which forms an electrostatic latent image on an electrophotographic photosensitive member through an electrophotographic process and visualizes the electrostatic latent image with a developer contained in a developing device, and more particularly to an electrophotographic image forming apparatus having developer amount detecting means capable of sequentially detecting the remaining amount of developer contained in a developer container, a process cartridge and a developing device,.

The electrophotographic image forming apparatus is directed to, for example, an electrophotographic copying machine, an electrophotographic printer such as an LED printer or a laser beam printer, an electrophotographic facsimile machine and an electrophotographic word processor.

The process cartridge makes at least one of charging means, developing means and cleaning means and an electrophotographic photosensitive member integrally into a cartridge which is detachably mountable to a main body of the electrophotographic image forming apparatus, or makes at least the developing means and the electrophotographic photosensitive member integrally into a cartridge which is detachably mountable to a main body of the electrophotographic image forming apparatus.

2. Related Background Art

Up to now, in an image forming apparatus using an electrophotographic image forming process, there has been applied a process cartridge system which makes the electrophotographic photosensitive member and process means that acts on the electrophotographic photosensitive member integrally into a cartridge which is detachably mountable to a main body of the electrophotographic image forming apparatus. The process cartridge system can remarkably improve the operability since the maintenance of the apparatus can be conducted by a user per se not depending on a service man. For that reason, the process cartridge system has been widely employed in the electrophotographic image forming apparatus.

In one type of the electrophotographic image forming apparatuses of the above process cartridge system, a user per se can exchange the cartridge. Therefore, there includes one having means for informing the user of a fact that the developer has been consumed, that is, a developer amount (presence and absence) detecting device.

The details will be further described. FIG. 14 shows an example of an image forming apparatus A to which a conventional process cartridge B is mounted. A developing device 10 which constitutes developing means by the process cartridge B includes a developer container 11 having a developing portion 13 which supplies a developer T to a latent image formed on a photosensitive drum 1 serving as an image bearing member to visualize the latent image and a hopper portion 14 provided for the purpose of reserving and storing the developer T. Then, the developer T within the hopper portion 14 is fed to the developing portion 13 from the interior of the hopper portion 14 through the gravity and an agitating device 15 or other developer feeding means.

In the developing portion 13, a developing roller 12 that serves as a developer bearing member for feeding the developer T up to a developing position opposite to the photosensitive drum 1 is disposed in the vicinity of the photosensitive drum 1. The developer T is stuck and borne on the surface of the developing roller 12, and the developer T is fed up to the developing position opposite to the photosensitive drum 1 due to the rotation of the developing roller 12.

The amount and height of the developer T are regulated and uniformly coated on the developing roller 12 by developer regulating means 17 such as a doctor blade while the developer T is being fed. The developer T is rubbed by the developing roller 12, the developer regulating means 17 or the developer T per se so as to be charged during a process where the developer T is fed onto the developing roller 12.

Then, the developer T fed to a portion of the developing roller 12 opposite to the photosensitive drum 1 by the developing roller 12, that is, to a developing position in which the developer T is transferred onto the photosensitive drum 1 due to an appropriate developing bias voltage applied between the photosensitive drum 1 and the developing roller 12 by a developing bias power supply 12A which serves as bias applying means, and an electrostatic latent image on the photosensitive drum 1 is then developed to form a toner image.

The developer T which has not been used for development is fed while it remains on the developing roller 12, and then again contained in the developing portion 13.

On the other hand, a recording medium P set in a sheet feeding cassette 20 is conveyed to a transfer position by a pickup roller 21 and conveying means 22 having a conveying roller pair, a registration roller (not shown) and so on in synchronism with the formation of the toner image. A transfer roller 4 is disposed as transfer means at the transfer position, and the toner image on the photosensitive drum 1 is transferred onto the recording medium P by application of a voltage.

The recording medium P to which the toner image has been transferred is conveyed to fixing means 5 by a conveying guide 23. The fixing means 5 includes a driving roller **5*c* and a fixing roller 5*a* having a heater 5*b* therein which applies heat and pressure to the recording medium P which is passing through the fixing means 5** to fix the transferred toner image onto the recording medium P. Thereafter, the recording medium P is discharged to the external of the apparatus.

The photosensitive drum 1 after the toner image thereon has been transferred onto the recording medium P by the transfer roller 4, is subjected to a succeeding image forming process after the developer remaining on the photosensitive drum 1 has been removed by cleaning means 6. The cleaning means 6 scrapes off the residual developer on the photosensitive drum 1 by an elastic cleaning blade 7 disposed so as to be abutted against the photosensitive drum 1 and collects the residual developer into a waste developer reservoir 8.

As described above, in the developing device 10, because the developer T is consumed every time the developing operation is repeated, it is necessary to monitor the presence and absence of the developer T in the developing portion 13 at any time so as to prevent the shortage of the developer T.

Since the developer T is contained within the developer container 11 of the developing device 10, the user cannot recognize the residual amount of developer T from the outside using his eyes.

Under the above circumstances, the conventional developing device 10 includes a developer amount detecting device as near-end detection means for detecting the residual amount of the developer, and the developer amount detecting device includes a bar-shaped antenna electrode 18 for detection of the residual amount of the developer which is disposed horizontally in the interior of the developing portion 13 in order to detect the residual amount of the developer T.

As described above, there has been applied a system in which an alternate (a.c.) bias voltage from the developing bias power supply 12A is applied to the developing roller 12 when the image is formed, and in this situation, the developer amount detecting device detects an electric current that flows in the antenna electrode 18 by the a.c. bias voltage. That is, the detection of the developer residual amount utilizes a change in the capacitance due to the amount of developer that is interposed between the developing roller 12 and the antenna electrode 18.

That is, the current that flows in the antenna electrode 18 gradually changes as the developer T contained in the developer container 11 is gradually consumed every time an image is formed. Therefore, when its value reaches a given value, that time is indicated on a personal computer or an operation panel of a printer as a toner end so that information of no developer can be transmitted to the user.

As described above, the conventional developer amount detecting device is adapted to detect the presence and absence of the developer T within the developer container 11, that is, it can merely detect that the amount of developer T is small immediately before the developer within the developer container 11 is completely consumed. Thus, the conventional developer amount detecting device cannot detect the residual amount of developer T within the developer container 11.

On the contrary, if the residual amount of developer T within the developer container 11 can be sequentially detected, the user can be notified of a state in which the developer within the developer container 11 is consumed. Therefore, the user can prepare a new process cartridge at a replacement timing.

Under the above circumstances, in order to sequentially detect the residual amount of developer together with the use of the near-end detecting means, there have been proposed that the respective image signals for forming image dots are counted and multiplied by a given coefficient to detect the consumed amount of developer, or a period of time of transmitting a light emitting signal to a laser or the like which produce an electrostatic latent image is integrated to sequentially grasp the residual amount of developer.

The above combination of the developer residual amount sequential detection with the near-end detecting means makes it possible to sequentially notify the user of the residual amount of developer, and the information of no developer can be accurately transmitted to the user by the near-end detecting means.

However, in the means for sequentially detecting the developer residual amount to count the respective image signals which form the image dots as in the above conventional device, because the consumed amount of developer is different depending on the type of image, that is, between a line portion and an independent dot portion, there is a fear that an error may occur when the amount of developer is detected.

In addition, the near-end detecting means in the above conventional device can normally print 200 to 300 sheets at a printing ratio of 4% after the information of no developer has been transmitted to the user, but the specific number of printable sheets depends on an area of transfer material to be used and the printing ratio. For that reason, it is difficult to discriminate how many sheets can be printed.

SUMMARY OF THE INVENTION

The present invention has been made in view of the above circumstances, and therefore an object of the present invention is to provide a developing device, a process cartridge and an electrophotographic image forming apparatus, capable of sequentially detecting the residual amount of developer.

Another object of the present invention is to provide a developing device, a process cartridge and an electrophotographic image forming apparatus, capable of sequentially detecting the residual amount of developer with high accuracy.

Still another object of the present invention is to provide a developing device, a process cartridge and an electrophotographic image forming apparatus having developer amount detecting means capable of sequentially detecting the residual amount of developer with accuracy, which are inexpensive and capable of improving the convenience when the user employs the apparatus.

Still another object of the present invention is to provide a developing device, a process cartridge, and an electrophotographic image forming apparatus using the developing device and the process cartridge, which include N number of antenna electrodes ($N \geqq 2$) for detecting the residual amount of developer within a developer container by detecting a variation of a capacitance by a developing bias voltage applied to a developer bearing member, where in said n-th antenna electrode, a projected area (S) and a distance (R) from the developer bearing member satisfy the following expressions:

$$Sn-1 \leqq Sn, \text{ and } Rn-1 \leqq Rn \ (2 \leqq n \leqq N)$$

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Hereinafter, a description will be given in more detail of a developing device, a process cartridge and an electrophotographic image forming apparatus in accordance with the present invention with reference to the accompanying drawings.

First Embodiment

Figure 1:
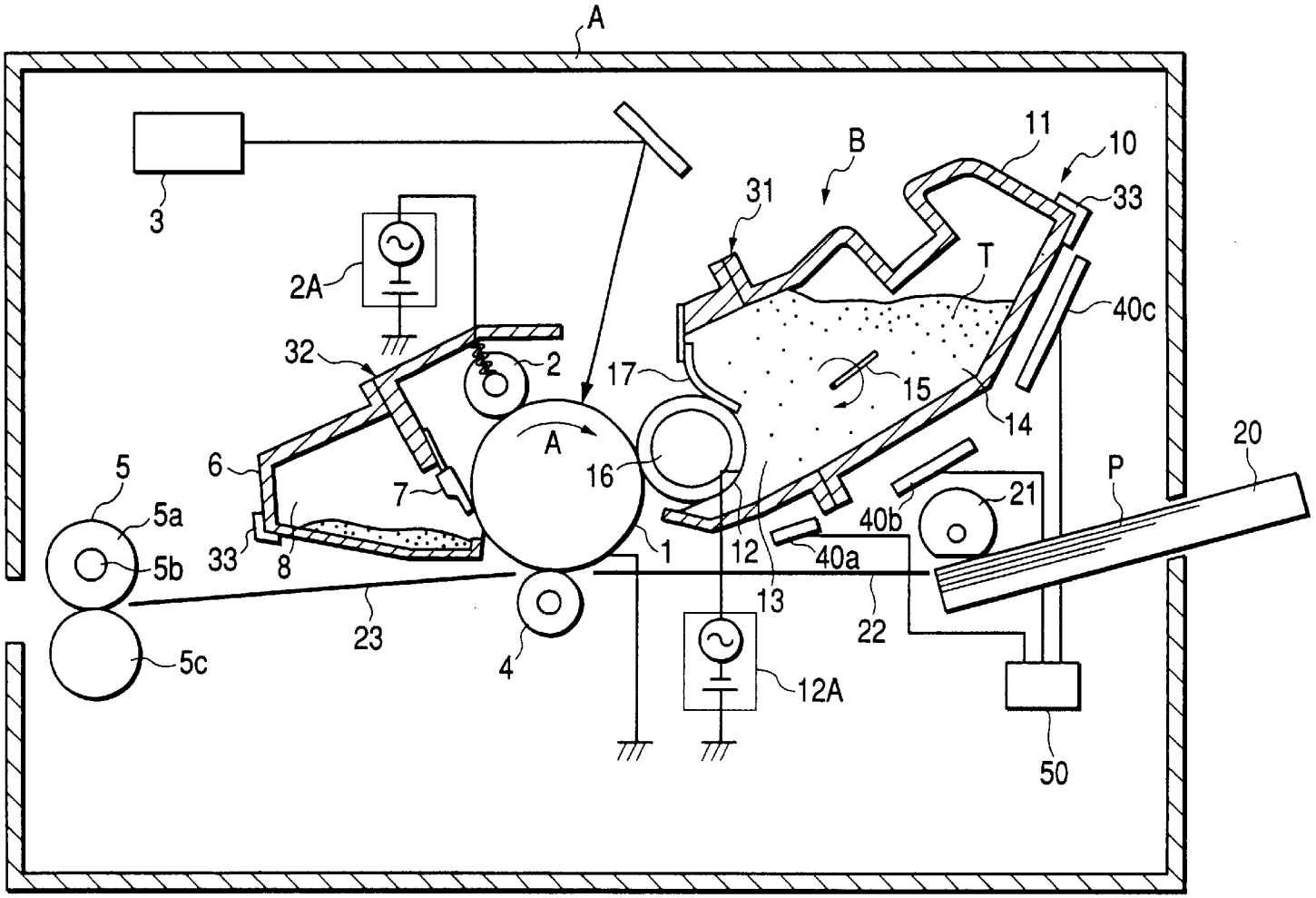
FIG. 1 is a structural diagram showing an outline of an image forming apparatus in accordance with an embodiment of the present invention.

First, a description will be given of an electrophotographic image forming apparatus to which a process cartridge is detachably mountable in accordance with an embodiment of the present invention with reference to FIG. 1. In this embodiment, the electrophotographic image forming apparatus is directed to an electrophotographic laser beam printer by which an image is formed on a recording medium such as a recording sheet, an OHP sheet or a cloth through an electrophotographic image forming process.

A laser beam printer A includes a drum-shaped electrophotographic photosensitive member, that is, a photosensitive drum 1. The photosensitive drum 1 is charged by a charging roller 2 which is charging means that structures electrostatic latent image forming means and is connected to a bias power supply 2A. Then, a laser beam is irradiated onto the photosensitive drum 1 from optical means 3 having a laser diode, a polygon mirror, a lens, a reflecting mirror (not shown) in response to image information, to thereby form a latent image corresponding to the image information on the photosensitive drum 1. The latent image is developed by a developing device 10 that serves as the developing means of a process cartridge B to form a visible image, that is, a toner image.

The developing device 10 is equipped with a developer container 11 which includes a developing portion 13 with a developing roller 12 that serves as a developer bearing member, and a developer hopper portion 14. In the case where a developer T contained in the developing portion 13 and the hopper portion 14 is consumed, a user per se replaces the cartridge B by a new one so that the developing device 10 can conduct new printing operation.

Also, the developing device 10 is equipped with an agitating device 15 within the developer hopper portion 14 for the purposes of preventing the developer T from being stuck onto the interior and of circulating and feeding the developer T. The agitating device 15 can be made of a resin film such as PET (polyethylene terephthalate), a rubber material such as silicone rubber or urethane rubber, or a sheet metal such as SUS or phosphor bronze. The agitating device 15 is rotated by driving means (not shown) in a direction indicated by an arrow.

Also, in this embodiment, the developing roller 12 has a stationary magnet 16 therein, and the developer T is fed by the rotation of the developing roller 12. Triboelectrification charges are given to the developer T and the developer T is also formed into a developer layer having a given thickness by the developing blade 17 that serves as the developer amount regulating member, and the developer layer is supplied to the developing region of the photosensitive drum 1. The developer supplied to the developing region is transferred to a latent image on the photosensitive drum 1 to form a toner image. The developing roller 12 is connected to a developing bias power supply 12A, and a developing bias voltage resulting from superimposing a d.c. voltage on an a.c. voltage is normally applied to the developing roller 12.

Also, in this embodiment, the developing device 10 uses a magnetic developer containing magnetic substance as the developer T, however, nonmagnetic developer containing no magnetic substance may be used as the developer T. Therefore, the developing device 10 may be structured as a magnetic monocomponent developing device in which the developer per se contains magnetic carriers therein as in this embodiment. Also, the developing device 10 may be formed of a two-component developing device having the magnetic carriers or a nonmagnetic monocomponent developing device using no magnetic carriers.

The developer T which is contained and used in the developing device 10 is produced through a crushing method or a polymerizing method, and in the developing device 10 of this embodiment, a developer small in average particle diameter is employed so as to reproduce even a fine image.

On the other hand, a recording medium P set in a sheet feeding cassette 20 is conveyed to a transfer position by a pickup roller 21 and conveying means 22 having a conveying roller pair, a registration roller (not shown) and so on in synchronism with the formation of the toner image. A transfer roller 4 is disposed as transfer means at the transfer position, and the toner image on the photosensitive drum 1 is transferred onto the recording medium P by application of a voltage.

The recording medium P to which the toner image has been transferred is conveyed to fixing means 5 by a conveying guide 23. The fixing means 5 includes a driving roller 5*c* and a fixing roller 5*a* having a heater 5*b* therein which applies a heat and a pressure to the recording medium P which is passing through the fixing means 5 to fix the transferred toner image onto the recording medium P. Thereafter, the recording medium P is discharged to the external of the apparatus.

The photosensitive drum 1 the toner image on which has been transferred onto the recording medium P by the transfer roller 4 is subjected to a succeeding image forming process after the developer remaining on the photosensitive drum 1 has been removed by cleaning means 6. The cleaning means 6 scrapes off the residual developer on the photosensitive drum 1 by an elastic cleaning blade 7 disposed so as to be abutted against the photosensitive drum 1 and collects the residual developer into a waste developer reservoir 8.

On the other hand, in this embodiment, a process cartridge B provides a developing frame 31 that holds the developer container 11 that constitutes the developing device 10, etc., and a cleaning frame 32 to which the photosensitive drum 1, the cleaning means 6 such as the cleaning blade 7 and the charging roller 2 are fitted integrally into a cartridge.

The process cartridge B is detachably mounted on cartridge mounting means 33 disposed in a main body of an electrophotographic image forming apparatus.

In the process cartridge B having a structure described above, the developer T contained in the developer container 11 is gradually consumed every time an image is formed. According to the present invention, the process cartridge B is equipped with a developer amount detecting device capable of sequentially detecting the residual amount of developer as the developer in the developing container 11 is consumed.

Subsequently, the developer amount detecting device will be described. Referring to FIG. 1, a plurality of antenna electrodes 40, in this embodiment, three antenna electrodes 40 (40*a*, 40*b*, 40*c*) are disposed in parallel with the longitudinal direction of the developing roller 12 as the antenna electrodes for detecting the residual amount of developer. The respective antenna electrodes 40*a*, 40*b* and 40*c* are formed of electrically conductive plate members, that is, metal plates. The metal plate may be formed of an arbitrary metal plate which is, for example, about 0.5 to 5 mm in thickness and made of aluminum or stainless steel.

Figure 2:
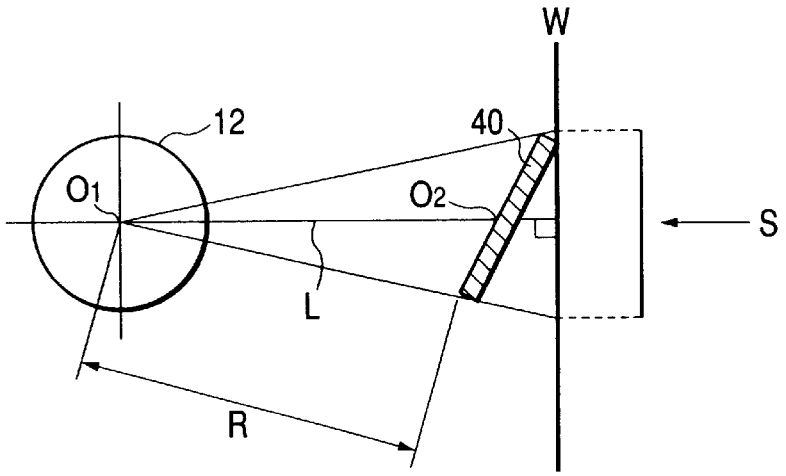
FIG. 2 is a diagram for explaining a positional relationship between a developer bearing member and an antenna electrode.

Further, according to the present invention, as shown in FIG. 2, assuming a projected area of a plane W which is orthogonal to a center line L connecting a center $O_1$ of the developing roller 12 and a center $O_2$ of the antenna electrode 40 that serves as an inclined metal plate in the widthwise direction, and passes through an end portion of the metal plate 40 which is further from the developing roller 12 with the center $O_1$ of the developing roller 12 as a light source is (S), and a distance from the center $O_1$ of the developing roller 12 to another end of the metal plate 40 which is nearer to the developing roller 12 is (R), the positional relationship between the developing roller 12 and the respective antenna electrodes 40 (40*a*, 40*b*, 40*c*) is set to a shape and an interval which satisfy the following relationship.

That is, assuming that the projected areas (S) of the respective antenna electrodes 40*a*, 40*b* and 40*c* with the center of the developing roller 12 as a light source and the distances (R) of the respective antenna electrodes 40*a*, 40*b* and 40*c* from the center of the developing roller 12 are (Sa, Sb, Sc) and (Ra, Rb, Rc), respectively, the positional relationship of the developing roller 12 and the respective antenna electrodes 40*a*, 40*b* and 40*c* satisfy $Sa \leqq Sb \leqq Sc$, and $Ra \leqq Rb \leqq Rc$.

Accordingly, assuming that an N number of antenna electrodes 40 (40*a*, 40*b*, . . . 40*n*, . . . 40N) ($N \geqq 2$) are disposed, the n-th antenna electrode 40*n* is structured such that the projected area (Sn) and the distance (Rn) from the developing roller 12 satisfy $Sn-1 \leqq Sn$, and $Rn-1 \leqq Rn$ ($2 \leqq n \leqq N$).

Figure 3:
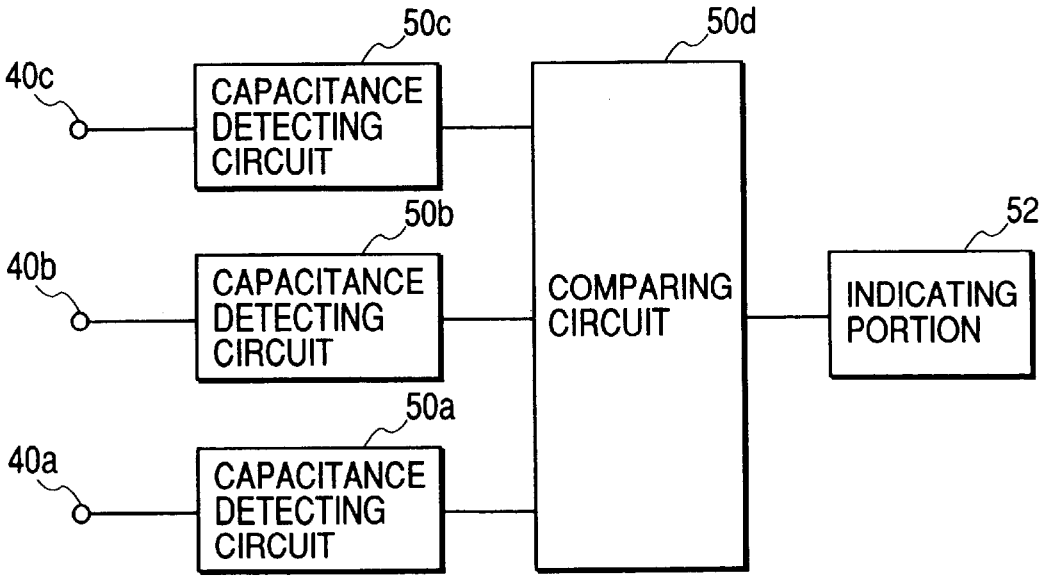
FIG. 3 is a developer amount measuring circuit for a developer residual amount detecting device in accordance with an embodiment of the present invention.

Further, the developer amount detecting device includes a developer amount measuring circuit that constitutes the developer amount detecting means 50 shown in FIG. 3, and is applied with a system that measures an electric current which flows in the antenna electrodes 40 (40*a*, 40*b*, 40*c*). Thus, the developer amount detecting device utilizes a variation of the capacitance due to the amount of developer which intervenes between the developing roller 12 and the antenna electrodes 40. That is, the current that flows in the antenna electrodes 40 gradually changes as the developer T contained in the developer container 11 is gradually consumed every time an image is formed. Therefore, if the signal is monitored, for example, on a personal computer or an operation panel of a printer through the developer amount detecting means 50 within the image forming apparatus, the amount of developer can be sequentially detected.

Figure 4:
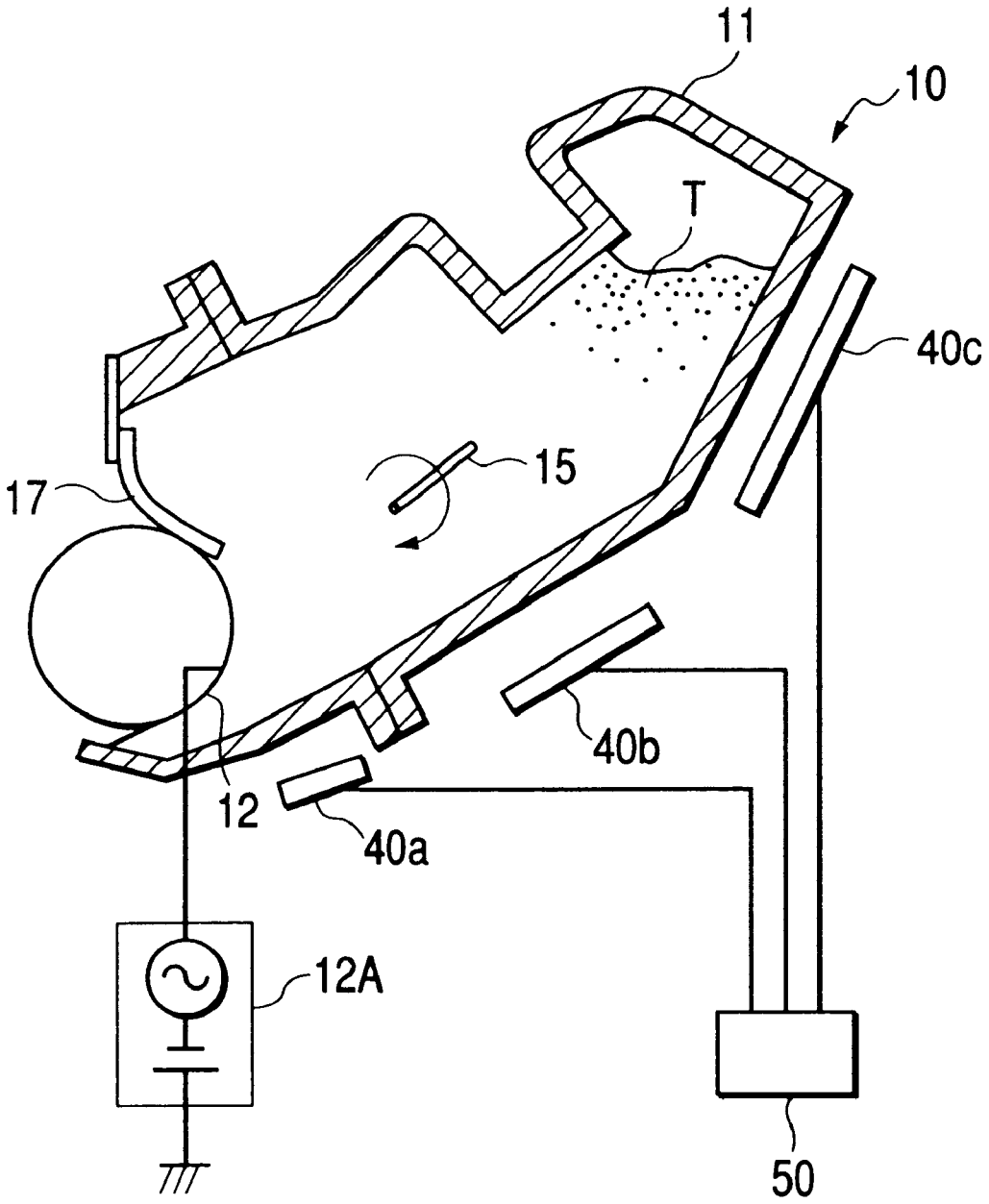
FIG. 4 is a diagram for explaining a developer residual amount detection in accordance with the present invention.
Figure 5:
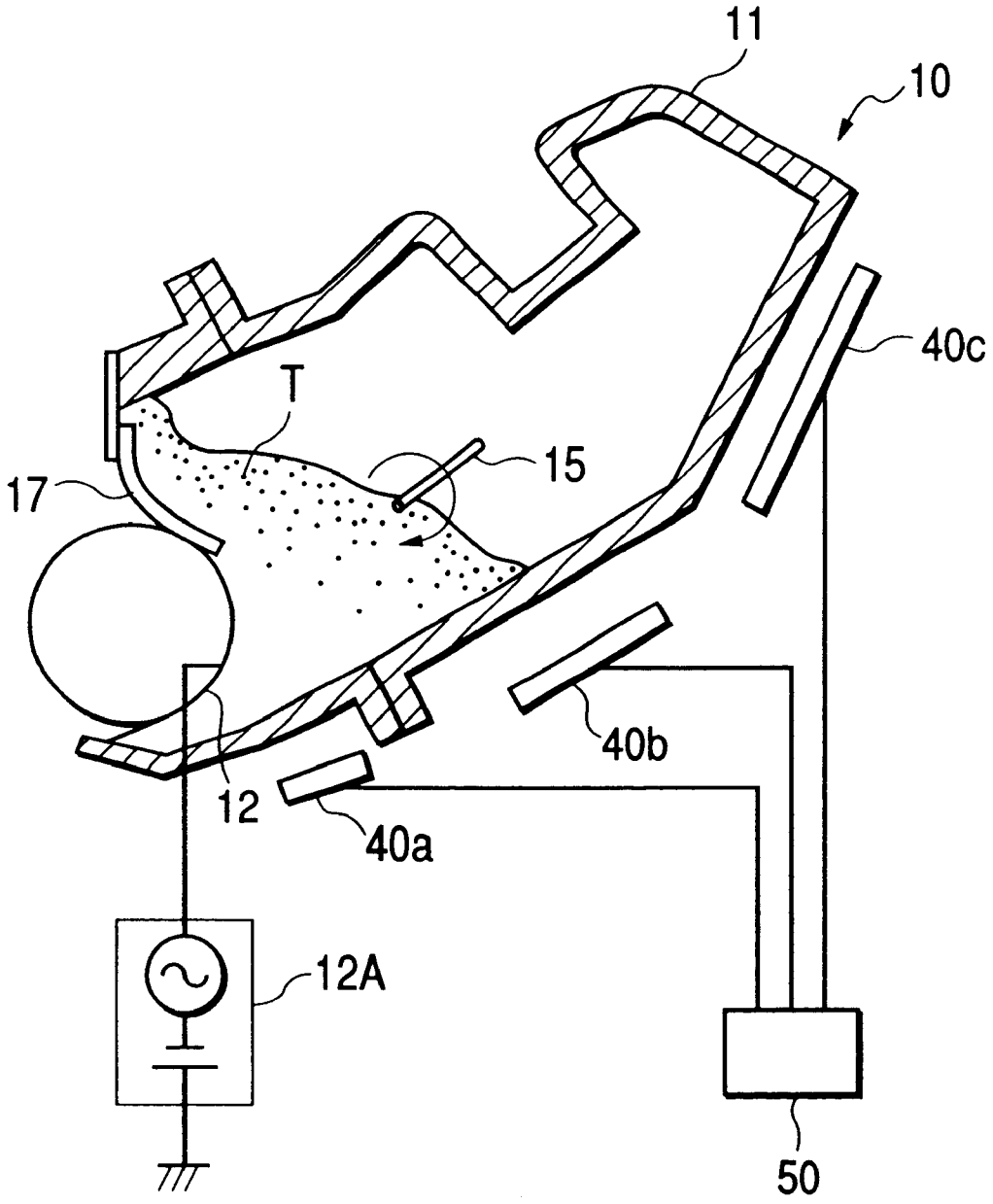
FIG. 5 is a diagram for explaining a developer residual amount detection in accordance with the present invention.
Figure 6:
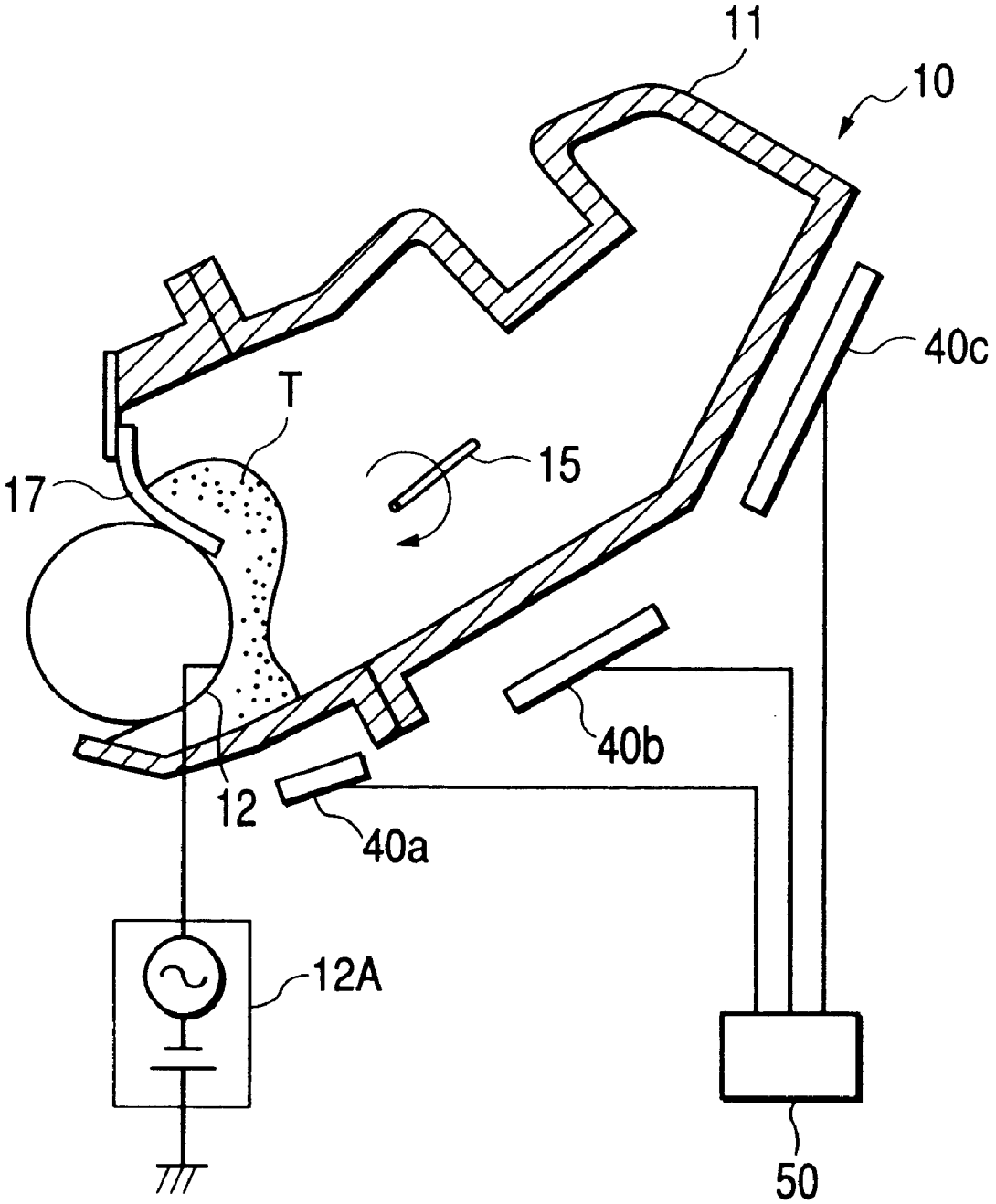
FIG. 6 is a diagram for explaining a developer residual amount detection in accordance with the present invention.
Figure 7A:
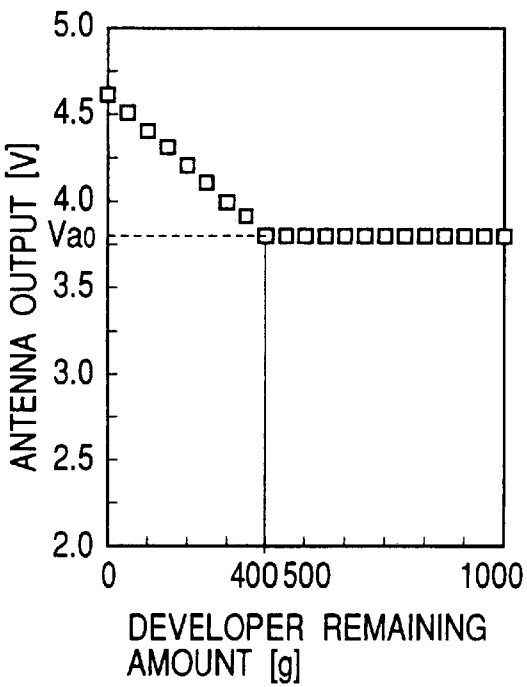
FIGS. 7A, 7B and 7C are diagrams for explaining a relationship between an antenna electrode output and a developer residual amount in detection of the residual amount of developer in accordance with the present invention, respectively.
Figure 7B:
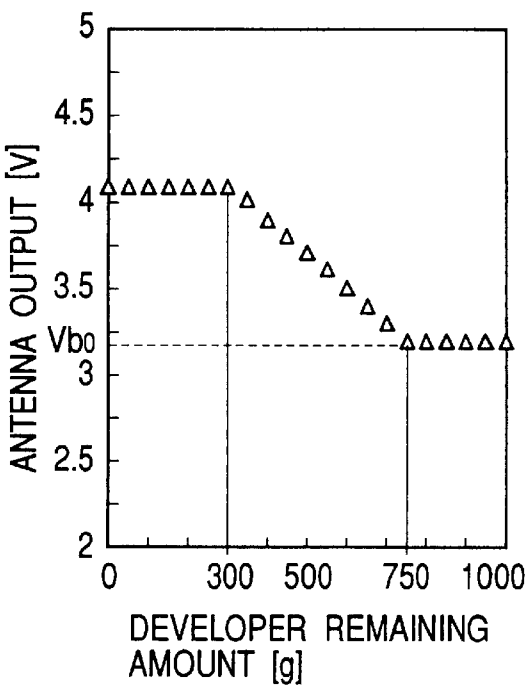

In more detail, in an initial state where a new process cartridge B is mounted on the printer, because no developer T is consumed, the developer T exists even in the vicinity of the antenna electrode 40*c* as shown in FIG. 4. Thereafter, the developer is consumed with the progression of image formation. The relationships between the consumed amount of developer and the outputs of the antenna electrodes 40*a*, 40*b* and 40*c* in that situation are represented in FIGS. 7A, 7B and 7C.

Figure 7C:
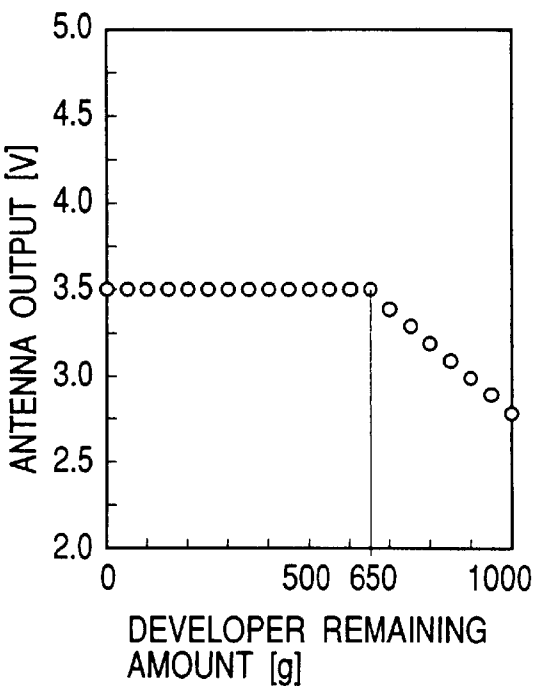

As shown FIG. 7C, the output value of the antenna electrode 40*c* gradually increases as the developer T is consumed and then becomes a constant value at a stage where the developer is consumed to a given value or more (for example, the residual amount of developer is 650 g).

On the contrary, the antenna electrodes 40*a* and 40*b* maintain their output values to given values (Va0, Vb0: $Va0 \geqq Vb0$) at the initial state, as shown in FIGS. 7A and 7B, respectively. At a stage where the developer is consumed, and the developer is consumed to a given value or more (for example, the residual amount of developer is 750 g), the output value of the antenna electrode 40*b* gradually becomes large and becomes a constant value at a stage where the developer is consumed to a given value or more (for example, the residual of developer is 300 g). On the other hand, at a state where the developer is consumed to a given value or more (for example, the residual amount of developer is 400 g), the output value of the antenna electrode 40*a* gradually becomes large with consumption of the developer.

Subsequently, a method of indicating the residual amount of developer from the outputs obtained from those three kinds of antenna electrodes will be described.

According to this embodiment, the developer amount measuring circuit that constitutes the developer amount detecting means 50 is structured as shown in FIG. 3. That is, in the developer amount detecting means 50, the antenna electrodes 40*a*, 40*b* and 40*c* are connected to the capacitance detecting circuits 50*a*, 50*b* and 50*c*, respectively. The respective capacitance detecting circuits 50*a*, 50*b* and 50*c* are connected to the comparing circuit 50*d*, and the residual amount of developer is indicated on the indicating portion 52 on the basis of data obtained by the comparing circuit 50*d*.

The outputs Va0 and Vb0 of the antenna electrodes 40*a* and 40*b* when the process cartridge B is mounted to the main body of the image forming apparatus in a state where the process cartridge B is initial are stored in a memory of the developer amount detecting means 50 disposed in the apparatus body and structured as described above.

The respective outputs of the antenna electrodes 40*a*, 40*b* and 40*c* are detected with the progression of the image formation. The output values of the antenna electrodes 40*a*, 40*b* and 40*c* are compared with the outputs Va0 and Vb0 of the antenna electrodes 40*a* and 40*b* by the comparing circuit 50*d*. In the case where the output values of the antenna electrodes 40*a* and 40*b* are Va0 and Vb0, respectively, the residual amount of developer is detected according to the output value of the antenna electrode 40*c*.

Subsequently, if only the output value of the antenna electrode 40*a* is Va0, the residual amount of developer is detected according to the output value of the antenna electrode 40*b*. Finally, the residual amount of developer is detected according to the output value of the antenna electrode 40*a* from a state where the output value of the antenna electrode 40*b* does not become Va0.

In other words, in this embodiment, the outputs from the antenna electrodes 40*a*, 40*b* and 40*c* are outputted in the order where the distances (R) from the developing roller 12 is larger, that is, in the stated order of the antenna electrodes 40*c*, 40*b* and 40*a*, to thereby sequentially detect the residual amount of developer.

The antenna electrodes 40*a*, 40*b* and 40*c* can be adjusted at the time of shipping the image forming apparatus so that the output values of antennas in a cleared state become given values. With this adjustment, a variation in the outputs of the antenna electrodes 40*a*, 40*b* and 40*c* due to the mounting positions is eliminated so as to sequentially detect the residual amount of developer with high precision.

Also, if the projected areas (S) of the antenna electrodes 40*a*, 40*b* and 40*c* are adjusted to given sizes so as to be larger as they are further distanced from the developing roller 12 on the basis of the results obtained by studying the projected areas (S) of the antenna electrodes 40*a*, 40*b* and 40*c*, a precision of detecting the residual amount of developer is improved. That is, in FIGS. 7A, 7B and 7C, the residual amount of developer can be sequentially detected with high performance without changing the detectable inclined portions from an initial state to the toner end.

The antenna electrodes 40*a*, 40*b* and 40*c* can be fitted onto the developer container 11 and also can be fitted to a process cartridge frame which is separated from the developer container 11. Also, the antenna electrodes 40*a*, 40*b* and 40*c* can be fitted onto the main body of the image forming apparatus if desired, and in this case, the structure of the developing device or a single member of the process cartridge can be simplified and the costs can be reduced.

Also, at least one of the plural antenna electrodes 40 (40*a*, 40*b*, 40*c*) can be located within the developer container 11 of the developing device.

For example, if the antenna electrode 40*a* nearest to the developing roller is located within the developer container 11, the sensitivity as the antenna electrode becomes high as compared with a case where the antenna electrode is located outside of the developer container 11 or in the main body of the image forming apparatus. In other words, even if the antenna electrode located within the developer container is made smaller in the projected area of the antenna electrode, it can provide the same sensitivity as that of other antenna electrodes.

Figure 8:
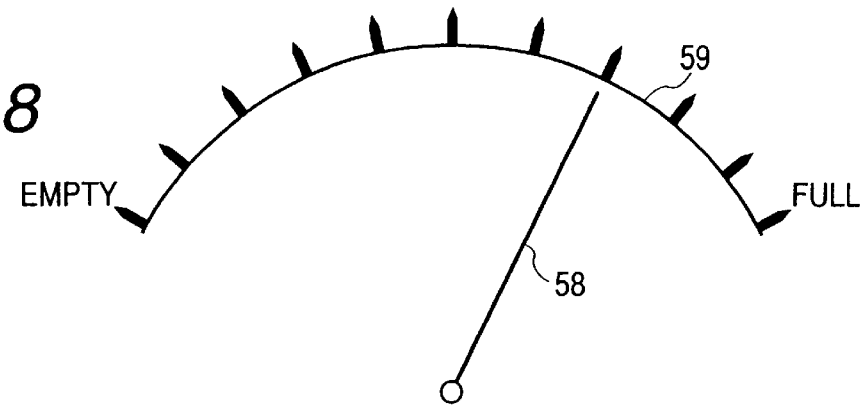
FIG. 8 is a diagram showing a developer amount indication in accordance with an embodiment of the present invention.
Figure 9:
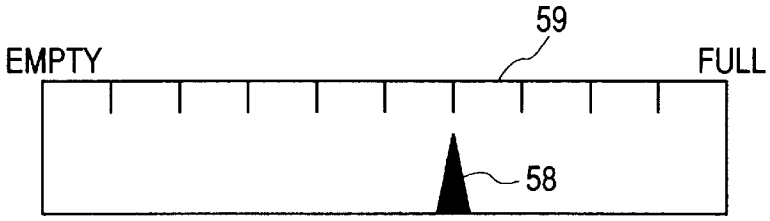
FIG. 9 is a diagram showing a developer amount indication in accordance with another embodiment of the present invention.

A method of indicating the developer will be described. For example, the detected information by the above-described developer amount detecting device is indicated on a terminal screen such as a user's personal computer as shown in FIGS. 8 and 9. In FIGS. 8 and 9, a pointer 58 which moves in response to the amount of developer indicates any position of a gage 59 so as to notify the user of the amount of developer.

Figure 10:
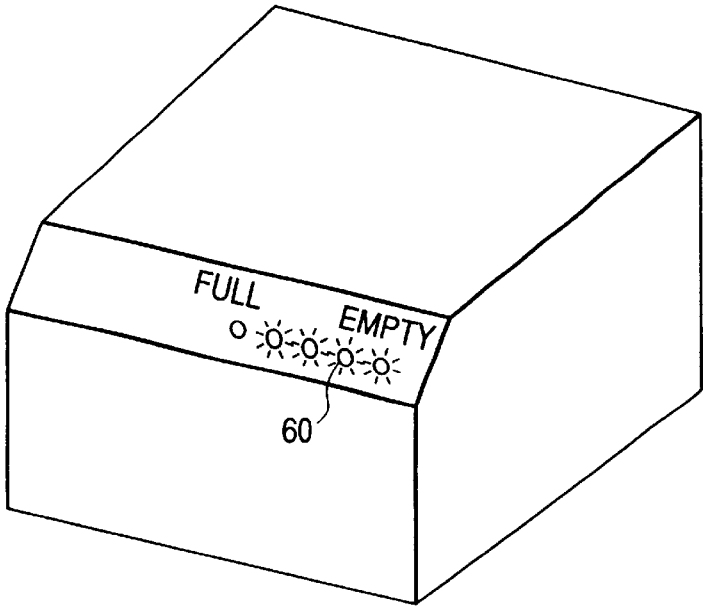
FIG. 10 is a diagram showing a developer amount indication in accordance with another embodiment of the present invention.

Also, as shown in FIG. 10, an indicating portion such as an LED 60 may be disposed directly on the main body of the electrophotographic image forming apparatus to flash the LED in response to the amount of developer.

Second Embodiment

Subsequently, a second method of sequentially detecting the residual amount of developer according to the output of the plurality of antenna electrodes 40 (40*a*, 40*b*, 40*c*) will be described. The structures and operation of the image forming apparatus, the developing device and the cartridge are identical with those described in the first embodiment, and therefore their description will be omitted.

As described above, the output values from the antenna electrodes 40*a*, 40*b* and 40*c* are changed due to a reduction of the developer with the procession of image formation as shown in FIGS. 7A, 7B and 7C. In this example, it is assumed that the output values from the antenna electrodes 40*a*, 40*b* and 40*c* are Vat, Vbt and Vct, respectively.

Figure 11:
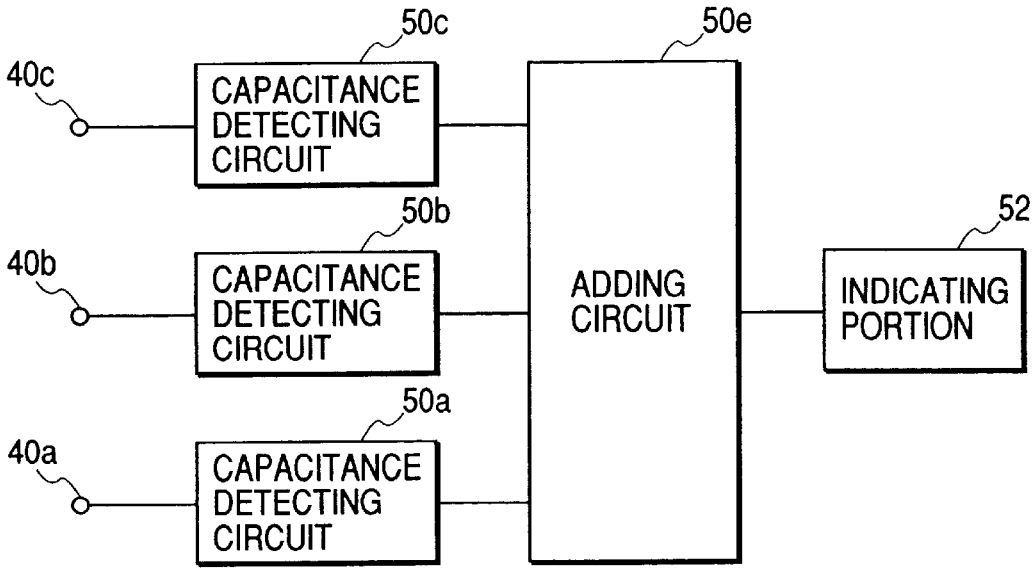
FIG. 11 is a developer amount measuring circuit for a developer residual amount detecting device in accordance with another embodiment of the present invention.

According to this embodiment, as shown in FIG. 11, the developer amount detecting circuit is identical with the developer amount detecting circuit (FIG. 3) described in the first embodiment, but includes a circuit 50*e* that adds the output values Vat, Vbt and Vct from the antenna electrodes 40*a*, 40*b* and 40*c* instead of the comparing circuit 50*d*. The output signal from the adding circuit 50*e* and the residual amount of developer have a relationship shown in FIG. 12. That is, since the added value is taken into the developer amount detecting circuit of the main body of the image forming apparatus, the residual amount of developer can be sequentially detected.

Figure 12:
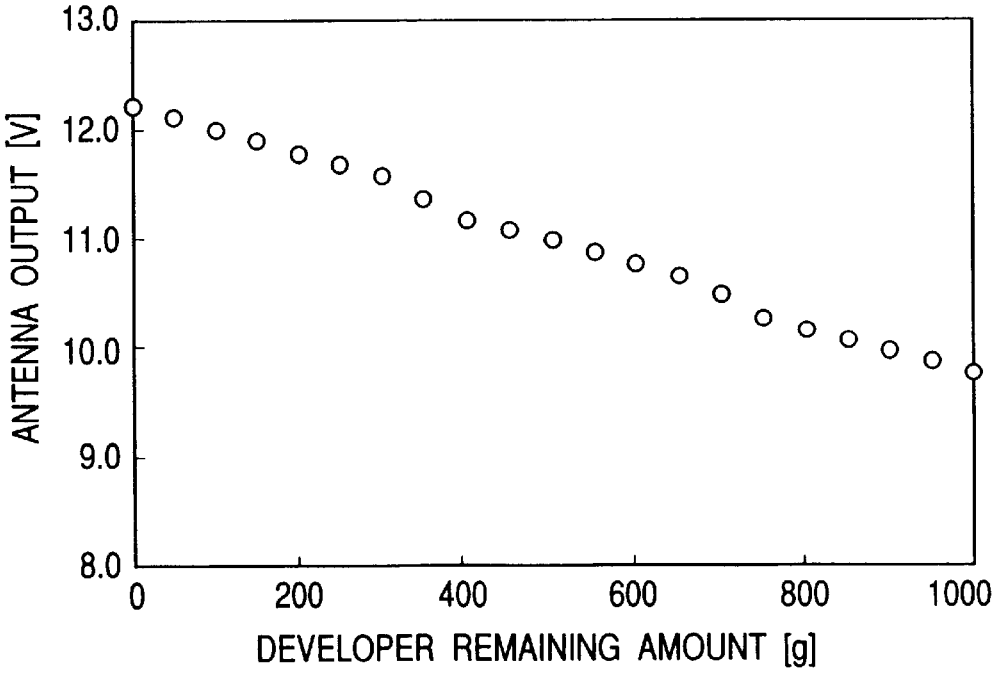
FIG. 12 is a diagram for explaining a relationship between an antenna electrode output and a developer residual amount in detection of the residual amount of developer in accordance with the present invention.

In this example, as in the first embodiment, if the projected areas of the antenna electrodes 40*a*, 40*b* and 40*c* are made larger to given sizes as they are further distanced from the developing roller 12, an ideal linear relationship can be obtained as shown in FIG. 12, to thus achieve an improvement in precision.

This embodiment can achieve the same effect as that in the first embodiment.

Third Embodiment

Figure 13:
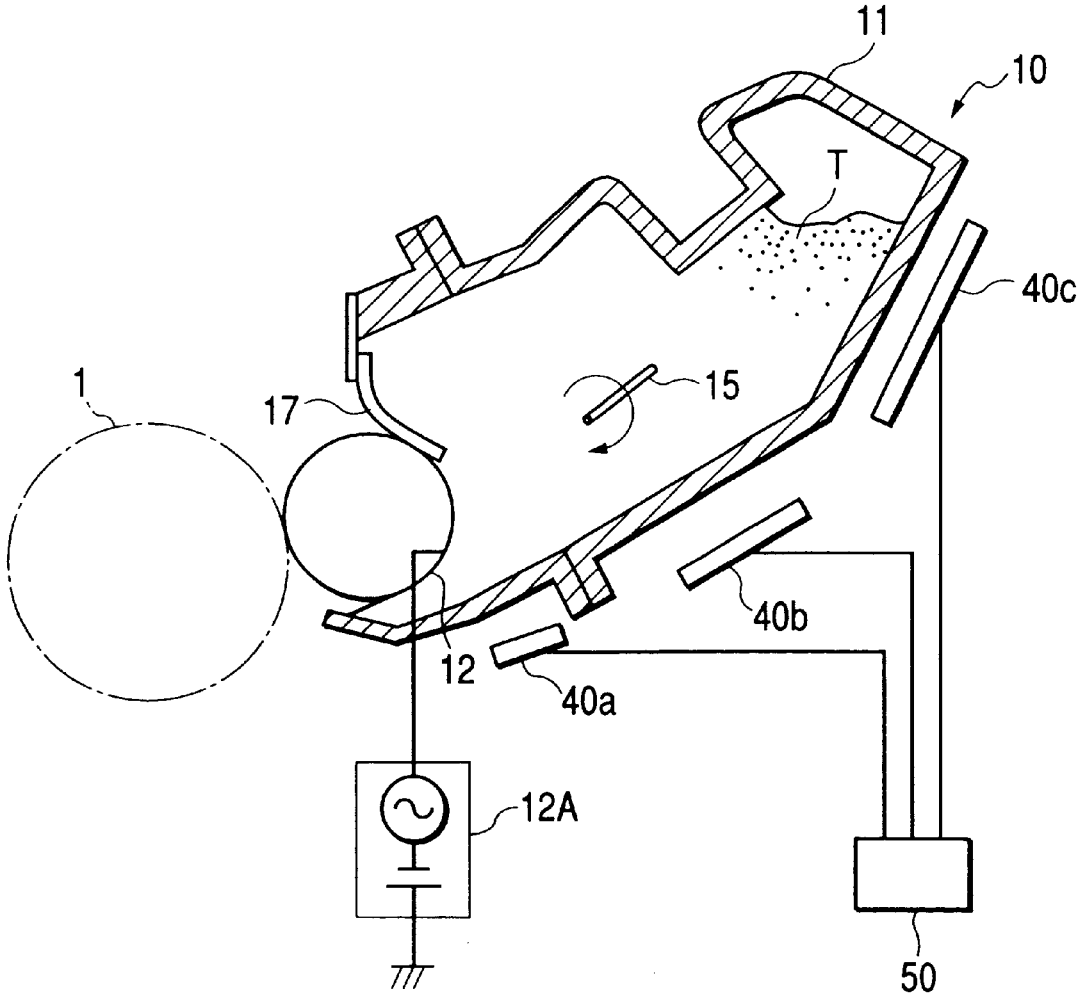
FIG. 13 is a structural diagram showing the outline of a developing device in accordance with an embodiment of the present invention.
Figure 14:
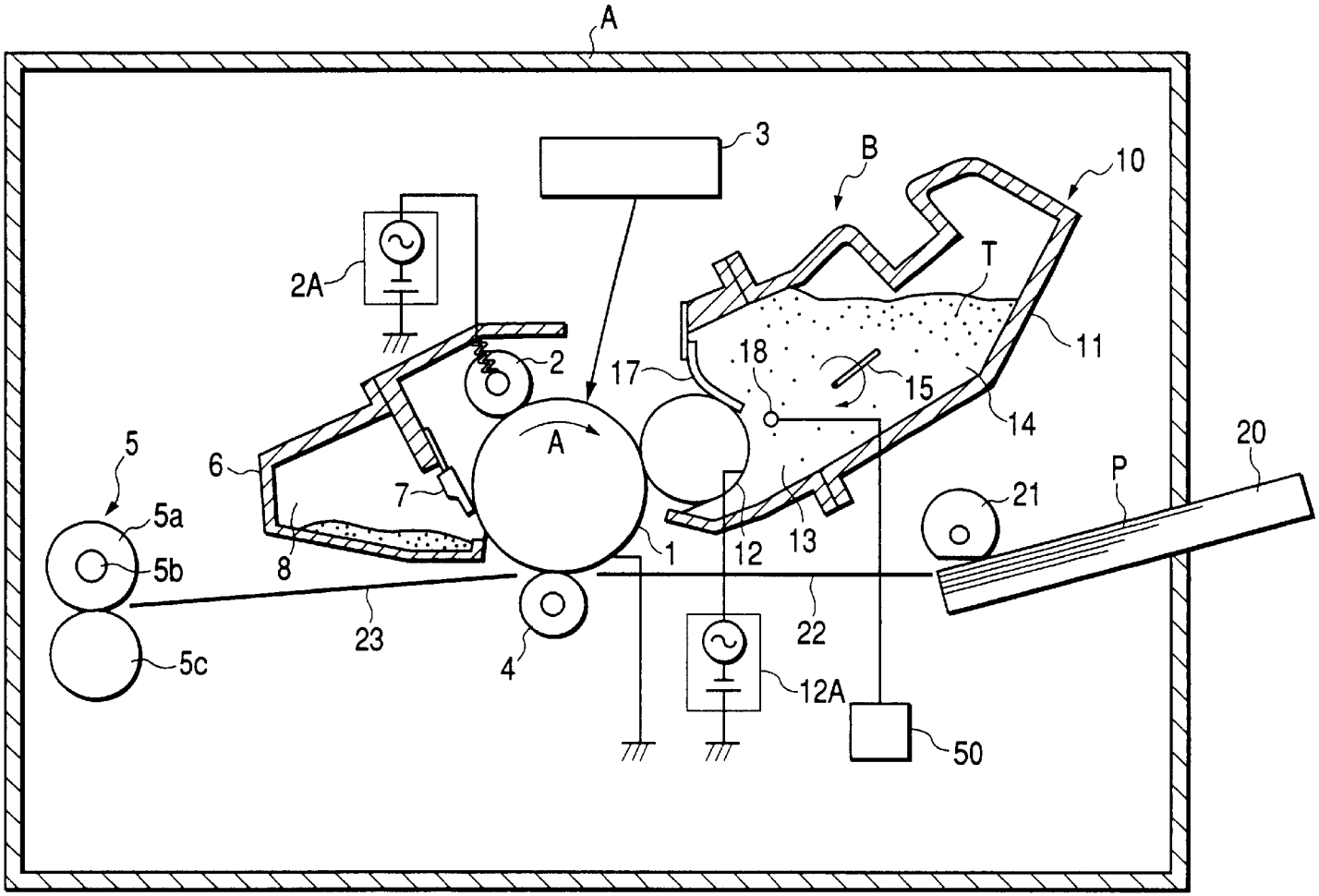
FIG. 14 PRIOR ART
FIG. 14 is a structural diagram showing the outline of a conventional image forming apparatus.

FIG. 13 shows a developing device made in a cartridge in accordance with another embodiment of the present invention.

A developing device 10 according to this embodiment includes a developer bearing member 12 such as a developing roller and a developer container 11 with a developing portion 13 and a hopper portion 14 each having toner therein in order to supply a developer to the developer bearing member 12, and makes those members 12 and 11 integrally into a cartridge. That is, the developing device according to this embodiment makes the developing device structural portion of the process cartridge B described in the first embodiment into a unit. That is, the developing device according to this embodiment can be regarded as a cartridge that makes the respective members except for the photosensitive drum 1, the charging means 2 and the cleaning means 6 from the process cartridge B integral. Therefore, all of the developing device structures and the developer amount detecting means structures as described in the first embodiment and the second embodiment are applied to the developing device of this embodiment, likewise. Accordingly, the description of those structures and functions is applied to the above description of the first embodiment.

It is needless to say that the same developer residual amount detecting means as that described in the first embodiment and the second embodiment is disposed in this embodiment, thereby making it possible to sequentially detect the residual amount of developer with high precision.

As was described above, the developing device, the process cartridge and the electrophotographic image forming apparatus according to the above-described embodiments include N number of antenna electrodes ($N \geqq 2$) for detecting the residual amount of developer within a developer container by detecting a variation of a capacitance by a developing bias voltage applied to a developer bearing member for feeding the developer to the electrophotographic photosensitive member to develop the electrostatic latent image formed on the electrophotographic photosensitive member, where in the n-th antenna, a projected area (S) and a distance (R) from the developer bearing member satisfy $Sn-1 \leqq Sn$, and $Rn-1 \leqq Rn$ ($2 \leqq n \leqq N$). Accordingly, the residual amount of developer can be accurately and sequentially detected with an inexpensive structure, and the convenience when the user uses the apparatus can be improved.

As was described above, according to the present invention, the residual amount of developer can be sequentially detected with high precision.

While the invention has been described with reference to the structures disclosed herein, it is not confined to the details set forth and this application is intended to cover such modifications or changes as may come within the purpose of the improvements or the scope of the following claims.

What is claimed is:

1. A developing device mounted on a main body of an electrophotographic image forming apparatus and for developing an electrostatic latent image formed on an electrophotographic photosensitive member, said developing device comprising:

a developer container which contains a developer therein and has a developer bearing member for feeding the developer to said electrophotographic photosensitive member in order to develop the electrostatic latent image formed on said electrophotographic photosensitive member; and antenna electrodes of a number N ($N \geqq 2$) for detecting a residual amount of developer within said developer container by detecting a variation of capacitance by a developing bias voltage applied to said developer bearing member, wherein a projected area (S) and a distance (R) of an n-th antenna electrode from said developer bearing member satisfy $Sn-1 \leqq Sn$, and $Rn-1 \leqq Rn$ ($2 \leqq n \leqq N$).

2. The developing device as claimed in claim 1, wherein at least one of said antenna electrodes is disposed in said developer container.

3. The developing device as claimed in claim 1 or 2, wherein outputs of said antenna electrodes are outputted in an order that the distances (R) from said developer bearing member are larger or outputted after the outputs from said respective antenna electrodes are added to sequentially detect the residual amount of developer.

4. The developing device as claimed in claim 1 or 2, wherein outputs from said antenna electrode are transmitted to developer amount detecting means for detecting the residual amount of developer which is disposed in the main body of said electrophotographic image forming apparatus.

5. The developing device as claimed in claim 1 or 2, wherein said developer bearing member comprises a developing roller.

6. The developing device as claimed in claim 1 or 2, wherein said developing bias voltage comprises an alternate bias voltage.

7. The developing device as claimed in claim 6, wherein said alternate bias voltage comprises a voltage in which a d.c. voltage is superimposed on an a.c. voltage.

8. The developing device as claimed in claim 5, wherein said antenna electrode comprises a metal plate member disposed to extend along a longitudinal direction of said developing roller.

9. A process cartridge detachably mountable on a main body of an electrophotographic image forming apparatus, said process cartridge comprising:

(a) an electrophotographic photosensitive member;

(b) a developing device including a developer container which contains a developer therein and has a developer bearing member for feeding the developer to said electrophotographic photosensitive member in order to develop an electrostatic latent image formed on said electrophotographic photosensitive member; and (c) antenna electrodes of a number N ($N \geqq 2$) for detecting a residual amount of developer within said developer container by detecting a variation of capacitance by a developing bias voltage applied to said developer bearing member, wherein a projected area (S) and a distance (R) of an n-th antenna electrode from said developer bearing member satisfy $Sn-1 \leqq Sn$, and $Rn-1 \leqq Rn$ ($2 \leqq n \leqq N$).

10. The process cartridge as claimed in claim 9, wherein at least one of said antenna electrodes is disposed within said developer container.

11. The process cartridge as claimed in claim 9 or 10, wherein outputs of said antenna electrodes are outputted in an order that the distances (R) from said developer bearing member are larger or outputted after the outputs from said respective antenna electrodes are added to sequentially detect the residual amount of developer.

12. The process cartridge as claimed in claim 9 or 10, wherein outputs from said antenna electrodes are transmitted to developer amount detecting means for detecting the residual amount of developer which is disposed in the main body of said electrophotographic image forming apparatus.

13. The process cartridge as claimed in claim 9 or 10, wherein said developer bearing member comprises a developing roller.

14. The process cartridge as claimed in claim 9 or 10, wherein the developing bias voltage comprises an alternate bias voltage.

15. The process cartridge as claimed in claim 14, wherein said alternate bias voltage comprises a developing bias voltage in which a d.c. voltage is superimposed on an a.c. voltage.

16. The process cartridge as claimed in claim 13, wherein said antenna electrode comprises a metal plate member disposed to extend along a longitudinal direction of said developing roller.

17. The process cartridge as claimed in claim 9 or 10, further comprising charging means for charging said electrophotographic photosensitive member.

18. The process cartridge as claimed in claim 9 or 10, further comprising cleaning means for removing the developer stuck on said electrophotographic photosensitive member.

19. An electrophotographic image forming apparatus for forming an image on a recording medium, comprising:

(a) an electrophotographic photosensitive member;

(b) electrostatic latent image forming means for forming an electrostatic latent image on said electrophotographic photosensitive member;

(c) a developing device including a developer container which contains a developer therein and has a developer bearing member for feeding the developer to said electrophotographic photosensitive member in order to develop the electrostatic latent image formed on said electrophotographic photosensitive member;

(d) antenna electrodes of a number N ($N \geqq 2$) for detecting a residual amount of developer within said developer container by detecting a variation of capacitance by a developing bias voltage applied to said developer bearing member; and (e) developer amount detecting means for detecting the residual amount of developer based on outputs from said antenna electrodes, wherein a projected area (S) and a distance (R) of an n-th antenna electrode from said developer bearing member satisfy $Sn-1 \leqq Sn$, and $Rn-1 \leqq Rn$ ($2 \leqq n \leqq N$).

20. An electrophotographic image forming apparatus to which a process cartridge is detachably mounted, for forming an image on a recording medium, said electrophotographic image forming apparatus comprising:

(a) mounting means for detachably mounting the process cartridge, the process cartridge including an electrophotographic photosensitive member, and a developing device which contains a developer therein and has a developer bearing member for feeding the developer to said electrophotographic photosensitive member in order to develop an electrostatic latent image formed on said electrophotographic photosensitive member;

(b) electrostatic latent image forming means for forming the electrostatic latent image on said electrophotographic photosensitive member;

(c) antenna electrodes of a number N ($N \geqq 2$) for detecting a residual amount of developer within said developer container by detecting a variation of capacitance by a developing bias voltage applied to said developer bearing member; and (d) developer amount detecting means for detecting the residual amount of developer based on outputs from said antenna electrodes, wherein a projected area (S) and a distance (R) of an n-th antenna electrode from said developer bearing member satisfy $Sn-1 \leqq Sn$, and $Rn-1 \leqq Rn$ ($2 \leqq n \leqq N$).

21. The electrophotographic image forming apparatus as claimed in claim 19 or 20, wherein at least one of said antenna electrodes is disposed in said process cartridge.

22. The electrophotographic image forming apparatus as claimed in claim 19 or 20, wherein the outputs of said antenna electrodes are outputted in an order that the distances (R) from said developer bearing member are larger or outputted after the outputs from said respective antenna electrodes are added to sequentially detect the residual amount of developer.

23. The electrophotographic image forming apparatus as claimed in claim 19 or 20, wherein said developer bearing member comprises a developing roller.

24. The electrophotographic image forming apparatus as claimed in claim 19 or 20, wherein the developing bias voltage comprises an alternate bias voltage.

25. The electrophotographic image forming apparatus as claimed in claim 24, wherein said alternate bias voltage comprises a voltage in which a d.c. voltage is superimposed on an a.c. voltage.

26. The electrophotographic image forming apparatus as claimed in claim 23, wherein said antenna electrode comprises a metal plate member disposed to extend along a longitudinal direction of said developing roller.

27. The electrophotographic image forming apparatus as claimed in claim 19 or 20, wherein said developer amount detecting means includes means for comparing the outputs from said respective antenna electrodes or means for adding the outputs of said respective antenna electrodes.

* * * * *